United States Patent [19]

Jamison

[11] Patent Number: 4,491,245

[45] Date of Patent: Jan. 1, 1985

[54] LIQUID DISPENSING CONTAINER

[76] Inventor: Mark D. Jamison, 3333 Sharon Pl., Zion, Ill. 60099

[21] Appl. No.: 361,443

[22] Filed: Mar. 24, 1982

[51] Int. Cl.[3] ..... B65D 35/50

[52] U.S. Cl. ..... 222/107; 222/541; 222/575; 383/44

[58] Field of Search ..... 222/575, 92, 107, 211, 222/541, 215, 212; D9/302; 383/43–44, 100, 906; 206/484

[56] References Cited

U.S. PATENT DOCUMENTS

| | | | |
|---|---|---|---|
| Re. 24,251 | 12/1956 | Kaplan et al. | 222/107 |
| 2,517,027 | 8/1950 | Rado | 222/94 |
| 3,009,498 | 11/1961 | Fohr | 150/9 |
| 3,651,995 | 3/1972 | Chaney | 222/211 |
| 3,862,684 | 1/1975 | Schmitt | 206/820 |
| 3,878,977 | 4/1975 | Carlisle | 222/491 |
| 3,917,116 | 11/1975 | Mason | 222/107 X |
| 4,171,755 | 10/1979 | Carlisle | 222/107 |
| 4,196,030 | 4/1980 | Ausnit | 156/91 |
| 4,275,840 | 6/1981 | Staar | 222/107 X |
| 4,331,264 | 5/1982 | Staar | 222/94 |

FOREIGN PATENT DOCUMENTS

| | | | |
|---|---|---|---|
| 656241 | 1/1963 | Canada | 222/107 |

*Primary Examiner*—Charles A. Marmor
*Attorney, Agent, or Firm*—Low & Low

[57] ABSTRACT

A liquid dispensing container of the pliable pouch type having a spout of a serpentine shape extending from the pouch and toward a marginal edge of the container. The spout is unsealed by tearing off an end of the container which has a pre-cut slit therein to facilitate the tearing.

8 Claims, 4 Drawing Figures

LIQUID DISPENSING CONTAINER

This invention relates to a liquid dispensing container, and, more particularly, it relates to a liquid dispensing container of the type which has pliable and overlying sheets which are sealed around their edges for containing a liquid between the sheets and which can be squeezed from between the sheets.

BACKGROUND OF THE INVENTION

The prior art is already aware of pliable or flexible containers for liquid-tightly containing liquids and like materials. Examples of such containers are found U.S. Pat. Nos. 2,517,027 and 3,009,498 and 3,862,684 and 3,878,977 and 4,171,755 and 4,196,030 and U.S. Pat. No. 24,251. The concern of the prior art container, as well as the concern of the container of the present invention, is to contain liquids in pliable pouches formed by two overlying sheets of flexible material, or similarly forming a liquid-tight container. Ultimately, the container is unsealed so that the liquid contents can be dispensed, as desired. One common use for this type of container is for food condiments, such as ketchup, mustard, and for dairy products, drugs, concentrates, and any and all considerations where liquid or other flowable material is to be contained in a tight pouch which can be readily opened for dispensing the contents when desired.

The present invention differs from the prior art mentioned in that the present invention provides a container having a spout portion which initially extends away from the main body or pouch portion of the container and then the spout portion is redirected to extend back toward the pouch portion and ultimately to the exterior of the entire container. With this arrangement, the contents can be dispensed only when pressure is applied to the pouch portion, and when pressure is released then the contents will not flow from the pouch portion, and this occurs when the user finger-squeezes the pouch portion and subsequently releases that squeezing pressure.

Still further, the container of this invention differs from the prior art in that it provides for a spout which has its outlet section directed diagonally, or at an angle, with respect to the length of the entire container or its pouch portion itself which presents an elongated axis or length and therefore has its spout outlet directed diagonally to that axis, all for ease and accuracy of dispensing the container contents through finger pressure, as described.

Still further, the present invention differs from the prior art in that it provides for a container of two sheets of pliable material which are biaxially oriented with respect to each other so that they cannot be torn through normal finger or even fingernail pressures, but instead a preliminary cut or slit in the edge of the material is required in order to tear the material to thereby open the spout when desired. Accordingly, the present invention provides for the arrangement of the two sheets of container material in the overlying or laminated form, but which do not tear without the aid of an initial tear, cut, or slit formed in their edges and with that slit extending in the direction which would intersect the otherwise sealed end of the container's spout portion, all for rendering the container unsealed for dispensing its contents.

Other objects and advantages, and distinctions over the prior art, include the provision of the pliable container mentioned and wherein the spout is of a reversely directed configuration along its length so that the dispensing material will actually reverse its direction of flow and will therefore flow out of the container only under adequate finger pressure and will actually form a trap in the spout when finger pressure is released, all for assuring that there will be no undesirable evacuation of the material without appropriate finger pressure applied to the container. These objectives are also achieved by virtue of the provision of a tapered spout which reduces its cross-sectional area toward the spout outlet, all for controlling the evacuation of the container contents, and the outlet is at a corner of the container so that it can be acurately dispensed.

Other objects and advantages will become apparent upon reading the following description in light of the accompanying drawing.

DETAILED DESCRIPTION OF THE PREFERRED EMBODIMENT

Figure 3:
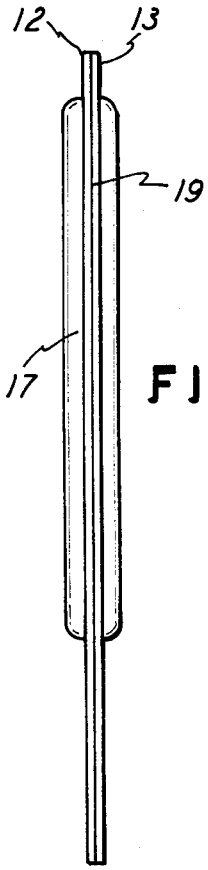

The container of this invention generally includes a pouch portion 10 and a spout portion 11, both of which are formed by two sheets of flexible material in overlying position to be fully matched around their edges, and the material is preferably plastic. Further, the material is of an orientation in its construction such that each of the two sheets 12 and 13, as seen in FIG. 3, have a specific orientation within themselves aand these two orientations are arranged in what is known as a biaxial arrangement. That is, the two sheets are of a material and are arranged with respect to each other so that ordinary tearing force, such as that commonly applied by a person's pinching fingernails, will not be able to tear the material at any of its sides or edges which are shown along the four sides of the container. A description hereinafter will explain how the container is torn and opened for using.

Figure 2:
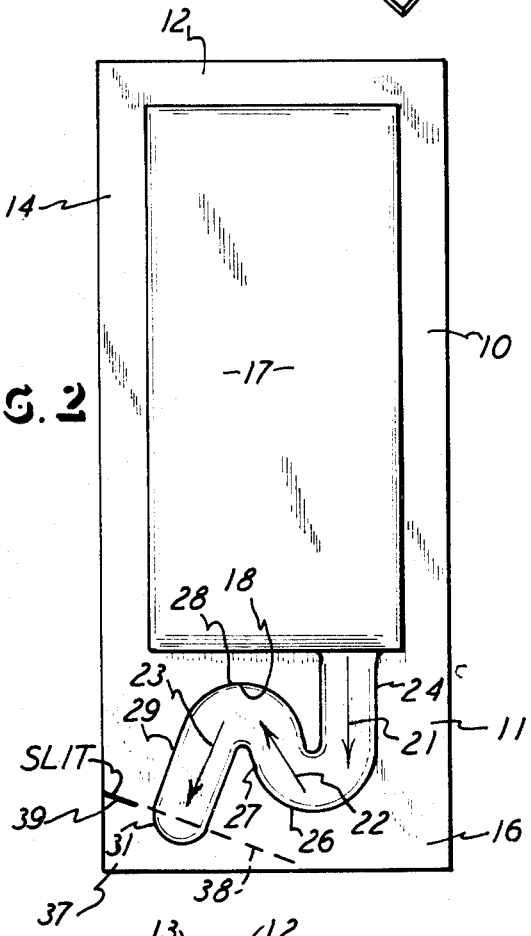
FIGS. 2 and 3 are enlarged front and side elevational views, respectively, of the container shown in FIG. 1.

The spout portion 11 is shown to extend for approximately one-quarter of the total length of the container which is elongated or has its length in the upright position as viewed in FIG. 2, for instance. Further, the two sheets 12 and 13 are suitably and conventionally sealed together at their marginal edges to form the sealed edges 14 and 16, each extending around the three sides of the pouch portion 10 and the three sides of the spout portion 11. That is, the two sheets 12 and 13 are sealed together in overlying relationship except for the rectangularly-shaped pouch 17 and the serpentine-shaped spout 18 which is in fluid-flow communication with the interior of the pouch 17. FIG. 3 shows the two sheets 12 and 13 spaced apart at the pouch 17, and thus the contents of the container are within the pouch 17, and such contents may be the liquid material described at the outset hereof. Therefore, the sheets 12 and 13 are on opposite sides of a common center plane 19 of the container, as viewed in FIG. 3.

Figure 4:
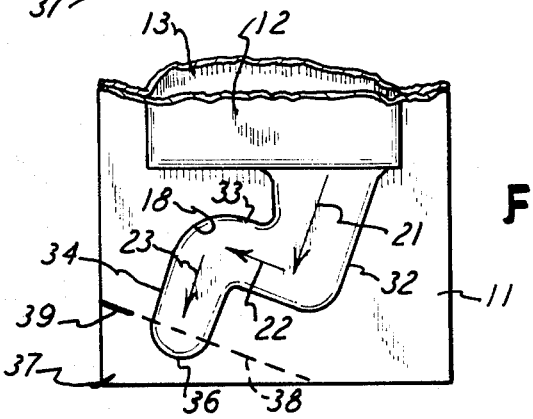
FIG. 4 is a front elevational view of a fragment of a container of this invention, but of an embodiment different from that shown in FIG. 2.

The spout portion 11 includes the spout 18 which is arranged to be of a reversely directed configuration along its length, and the spout 18 is in fluid-flow communication with the pouch 17, but is sealed by the spout portion seal 16. The two embodiments of spouts 18, as shown in FIGS. 2 and 4, have first sections 21 adjacent respective pouches 17, but directed away therefrom, and they have second spout portions 22 which are directed somewhat at least toward the pouches 17, and they have third or outlet sections 23 directed away from the pouches 17. With that arrangement, the spout 18 is reversely directed and at one portion in the flow of the contents from the pouch 17, the flow will have at least a component thereof in the direction toward the pouch 17, and that of course occurs in the second section 22, and these three sections are shown by the three arrows designated 21, 22, and 23. With that arrangement, when the spout 18 is open at its outlet end, the liquid contents will not flow through the spout 18 unless there is pressure applied to the pouch 17. Further, when pressure is released on the pouch 17, that is when a person;3 s fingers release that pressure, then there will be no flow through the spout 18 and there will be actually a flow trap created in the spout in its length intermediate the sections designated 21 and 22, and again there will therefore be no flow and will actually be a reverse flow of material when the pressure is released, all as desired so that there is no unnecessary or unwanted or messy dripping through the spout. Of course the vacuum created in the pouch 17 when finger pressure is released will cause a reverse flow in the spout 18 which itself can then contain the liquid material along its length and prevent the dripping or further flow, as mentioned.

The embodiment in FIG. 2 therefore shows a goose-neck type off spout configuration having its first straight portion 24 extending directly away from the pouch 17, and having a curved portion 26, which defines a pump, and a portion 27 directed back toward the pouch 17, and having another curved portion 28, and having a final outlet straight portion 29 having a terminal end 31. That is, throughout the spout 18, the two sheets 12 and 13 are not sealed together in the spout goose-neck configuration just described, and therefore the liquid can flow directly from the pouch 17 and through the serpentine spout 18 when the end 31 is removed or opened and that is when the spout 18 is unsealed.

The embodiment in FIG. 4 shows the first spout portion 32 to be at a slight angle with respect to the longitudinal or upright direction of the pouch 17, and it has a second portion 33 directed with a component in the direction of the pouch 17, and it has its third or outlet portion 34 extending away from the pouch 17, and it terminates in the end portion 36. The first length or section 32 is of a cross-sectional area greater than the outlet section 34, and therefore the spout in FIG. 4 is shown to be tapered inwardly toward its outlet portion 36.

In both spout embodiments, the outlet lengths or sections 29 and 34 are directed at the corner 37 of each respective container, and that direction is at an angle relative to the longitudinal direction of the pouch 17. With that arrangement, the user can neatly and accurately direct the flow of liquid through the outlet portion 34 since the corner of the container is being used for pointing and thereby directing the deposit of the liquid contents flowing through the outlet portions 29 and 34 which are at the angle relative to the length of the pouches 17, as shown and mentioned.

Figure 1:
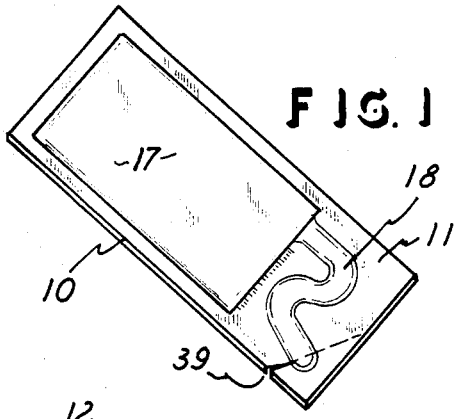
FIG. 1 is a top perspective view of a container of this invention.

To facilitate unsealing of the spouts 18, a tear line 38 is defined across the container end or corner 37, and that line is designated by the dotted line which is simply graphically representative of a tear line which could in actuality be a solid line or two areas of different color could meet on that line, or any other graphic arrangement for indicating that the user will tear along the line 38. However, as mentioned, the sheets 12 and 13 cannot be torn by fingernail application to the edges thereof. Therefore, a pre-cut or formed slit 39 is placed in the edge of the spout portion 11, as shown in FIGS. 1, 2, and 4, and that slit is shown to be a straight cut into the eges of the overlying sheets 12 and 13, and the slit is aligned with the tear-line 38 which extends across the end of the spout outlet portion 34, but at right angles thereto, as shown. Therefore, the user can grasp the portions of the container above and below the slit 39, and readily tear off the corner 37, and thereby remove the very tip of the spout outlet section 34 to unseal the spout 18.

With the container as described, it has been found that the container can be completely and securely sealed, and the end or corner 37 can be readily torn off by virtue of the arrangement of the biaxial sheets 12 and 13, and the slit 39. Further, with the outlet being directed to the corner of the container, the dispensing of the liquid contents can be accurately directed, rather than simply having liquid contents ooze or bubble out of a container, such as in the containers heretofore known. Further, it has been found that when finger pressure is released from the pouch 17, though there is still considerable liquid contents within the pouch, then the liquid will not flow through the spout 18 because of the reverse curve or direction formed in the spout 18 in its intermediate or pump section, as shown and described. There is therefore an improvement of avoiding dripping or a sluggish-type of discontinuance of flow compared to the moment at which finger pressure is released from the pouch 17.

In both embodiments, the two sheets 12 and 13 are liquid sealed together to define the integrally extending and continuous spout which is free of any interruption along its devious length. Also, the terminal ends 31 and 36, forming the spout outlets, are further from the pouch portion 17 than is the first spout portion 24 at its furthest point, that is, where portion 24 joins portion 26.

What is claimed is:

1. In a dispensing squeeze package for liquid contents wherein said package is formed from superposed sheets of flexible liquid-impermeable material connected in liquid-tight relation completely around the periphery thereof and defining therebetween (1) a contents-receiving pouch, and (2) a discharge spout communicating at an inlet end thereof with said pouch and terminating at an outlet end thereof within the periphery of said peripherally connected sheets, said sheets being tearable in proximity to said spout outlet end to disrupt said connected sheets near said spout outlet end to open the spout thereby to permit squeeze-dispensing pressure on said sheets at said pouch therein to force said contents from within said pouch through said spout to dispense the same, the improvement therein comprising:

said spout defining a flow channel formed between and defined completely by said superposed flexible sheets, with said sheets being connected together along the length of the channel on either side thereof between its said inlet and outlet ends, said flow channel having a serpentine configuration including a first flow channel portion extending from said inlet end in a first direction away from said contents pouch, a seocnd flow channel portion having a curvilinear connection to said first flow channel portion and extending therefrom in a second direction and including a reversely directed component thereof directed toward said contents pouch, a third flow channel portion having a curvilinear correction to said second flow channel portion and extending therefrom in a third direction to said outlet end and including a component thereof reversely directed with respect to said second flow channel component and extending away from said contents pouch in generally said first direction, and, tear means intersecting said spout at said outlet end thereof, thereby to provide a substantially flat squeeze package, the spout configuration of which provides manual squeeze-controlled flow from said contents pouch with dripless cessation of flow from said spout upon relaxation of squeeze pressure when said spout is opened at its outlet end.

2. The improved dispensing package of claim 1 wherein said spout is tapered to define said inlet end of greater width than said outlet end.

3. The improved dispensing package of claim 1 wherein said sheets are formed at least in part from polymeric material.

4. The improved dispensing packages of claim 3 wherein said sheets are bonded in face-to-face relation throughout their superposed surfaces peripherally of said pouch and said spout.

5. The improved dispensing package of claim 4 wherein said sheets are bonded by heat seals.

6. The improved dispensing package of claim 1 wherein said tear means extends across said spout third flow channel portion near the outlet end thereof.

7. The improved dispensing package of claim 6 wherein said package is substantially rectangular in outline, and said spout outlet end is disposed adjacent one corner of said package, with said tear means extending between adjacent package sides and across said spout outlet end therebetween.

8. The improved dispensing package of claim 3 wherein said sheets include biaxially oriented polymeric material.

* * * * *